US007066170B1

(12) United States Patent
Atemboski et al.

(10) Patent No.: US 7,066,170 B1
(45) Date of Patent: Jun. 27, 2006

(54) APPARATUSES AND METHODS FOR BALANCING COMBUSTION AIR AND EXHAUST GAS FOR USE WITH A DIRECT-VENT HEATER APPLIANCE

(75) Inventors: Alan Atemboski, Renton, WA (US); Leslie E. King, Monroe, WA (US)

(73) Assignee: Travis Industries, Inc., Kirkland, WA (US)

( * ) Notice: Subject to any disclaimer, the term of this patent is extended or adjusted under 35 U.S.C. 154(b) by 71 days.

(21) Appl. No.: 10/683,172

(22) Filed: Oct. 10, 2003

Related U.S. Application Data

(63) Continuation of application No. 09/703,206, filed on Oct. 31, 2000, now abandoned.

(51) Int. Cl.
*F24B 1/19* (2006.01)
*F24B 1/87* (2006.01)

(52) U.S. Cl. ..... 126/518; 126/77; 126/502; 126/515

(58) Field of Classification Search ..... 126/77, 126/74, 80, 85 B, 518, 515, 502, 504
See application file for complete search history.

(56) References Cited

U.S. PATENT DOCUMENTS

| | | | | |
|---|---|---|---|---|
| 548,079 | A * | 10/1895 | Miller | 126/99 R |
| 1,524,464 | A * | 1/1925 | Wiley | 110/147 |
| 2,258,729 | A * | 10/1941 | Best | 236/10 |
| 2,877,834 | A | 3/1959 | Campbell | |
| 2,916,983 | A | 12/1959 | Kinkead | |
| 3,765,823 | A | 10/1973 | Kawabata et al. | |
| 4,006,729 | A * | 2/1977 | Cesa | 126/518 |
| 4,043,313 | A * | 8/1977 | Sherman | 126/502 |

(Continued)

FOREIGN PATENT DOCUMENTS

| | | |
|---|---|---|
| DE | 1134811 | 8/1962 |

(Continued)

OTHER PUBLICATIONS

Berensohn, Roy, "Hearth and Home, A Homeowner's Guide to Gas Fireplaces", Dec. 1996, http://www.popularmechanics.com/popmech/homei/9612HIHIM.html, accessed Jun. 16, 2000.

*Primary Examiner*—Carl D. Price
(74) *Attorney, Agent, or Firm*—Perkins Coie, LLP

(57) ABSTRACT

A combustion air and exhaust gas balancing system for use with a direct-vent heater appliance. The balancing system includes a combustion air valve in fluid communication with a combustion air duct and an exhaust gas valve in fluid communication with an exhaust gas duct. The combustion air valve is operatively coupled to the exhaust gas valve with an actuator. The combustion air and exhaust gas valves are shaped and sized so that a single operation of the actuator simultaneously adjusts the flow of combustion air into the firebox and the flow of exhaust gas out of the firebox and provide selected flame characteristics in the firebox. In one aspect of this embodiment, a movement of the actuator in a first direction simultaneously increases the flow of combustion air and exhaust gas, and a movement of the actuator shaft in a second direction simultaneously restricts the flow of combustion air and exhaust gas. The actuator shaft is securable after final adjustment of the combustion air and exhaust gas flows to maintain the selected adjustment. In another embodiment, the exhaust gas duct includes a dilution air inlet aperture that permits combustion air to pass from the combustion air duct into the exhaust gas duct without first passing through the firebox.

6 Claims, 5 Drawing Sheets

U.S. PATENT DOCUMENTS

| | | | | | |
|---|---|---|---|---|---|
| 4,245,779 | A | | 1/1981 | Ardiente | |
| 4,292,952 | A | | 10/1981 | McDonald | |
| 4,362,146 | A | * | 12/1982 | Schuller | 126/504 |
| 4,389,980 | A | | 6/1983 | Marcotte et al. | |
| 4,424,792 | A | | 1/1984 | Shimek et al. | |
| 4,432,335 | A | * | 2/1984 | Kilham | 126/60 |
| 4,519,376 | A | * | 5/1985 | Schoeff et al. | 126/531 |
| 4,651,680 | A | | 3/1987 | Couprie | |
| 4,651,709 | A | * | 3/1987 | Schnetker | 126/77 |
| 4,903,615 | A | * | 2/1990 | Dreizler | 110/204 |
| 4,922,889 | A | * | 5/1990 | Nuesmeyer et al. | 126/73 |
| 5,012,793 | A | | 5/1991 | Guzorek | |
| 5,086,754 | A | * | 2/1992 | Narang | 126/110 R |
| 5,197,665 | A | | 3/1993 | Jenson et al. | |
| 5,542,407 | A | | 8/1996 | Hawkinson | |
| 5,603,312 | A | | 2/1997 | Champion et al. | |
| 5,697,330 | A | | 12/1997 | Yetman et al. | |
| 6,257,230 | B1 | | 7/2001 | Barudi et al. | |
| 6,612,301 | B1 | | 9/2003 | Vago | |

FOREIGN PATENT DOCUMENTS

| | | | |
|---|---|---|---|
| EP | 0109620 | | 5/1984 |
| EP | 0491444 | | 6/1992 |
| FR | 2552858 | | 4/1985 |
| FR | 2675886 | | 10/1992 |
| GB | 0 9090 959 | * | 7/1982 |
| JP | 51-118134 | | 10/1976 |
| JP | 52-48137 | | 4/1977 |
| JP | 55-831 | | 1/1980 |
| NL | 9400908 | | 1/1996 |

* cited by examiner

APPARATUSES AND METHODS FOR BALANCING COMBUSTION AIR AND EXHAUST GAS FOR USE WITH A DIRECT-VENT HEATER APPLIANCE

CROSS-REFERENCE TO RELATED APPLICATION

This application is a continuation of U.S. patent application Ser. No. 09/703,206 filed Oct. 31, 2000, now abandoned which is hereby incorporated by reference.

TECHNICAL FIELD

This invention is directed to direct-vent heater appliances, and more particularly, to apparatuses and methods for balancing combustion air and exhaust gas in direct-vent heater appliances.

BACKGROUND OF THE INVENTION

Vented heater appliances are well known and commonly used in residential dwellings and other structures for heating and esthetic purposes. Examples include gas-burning furnaces and gas-burning and wood-burning fireplaces. Traditional wood-burning fireplaces are not particularly efficient heaters, they tend to be dirty and require frequent cleaning due to the nature of the fuel used, and they require a constant supply of wood or other fuel. In view of the disadvantages of traditional wood-burning fireplaces, there has been a move to cleaner and more efficient gas-burning fireplaces.

Top-vent and direct-vent fireplaces make up the majority of gas-burning fireplaces sold in the United States. A top-vent fireplace vents exhaust to the outside and draws combustion air from the surrounding room. Direct-vent fireplaces draw combustion air from outside of the structure and vent exhaust gas to the outside using either a duct-within-a-duct arrangement or two separate ducts. Direct-vent fireplaces are either a free-standing style or a fireplace insert style positionable into a fireplace cavity built into the wall of a house, apartment, condominium, or other residential dwelling or structure. These direct-vent fireplaces are connected to suitable combustion air and exhaust gas ducts that communicate with the exterior of the dwelling.

FIG. 1 is a schematic side-elevational view of a conventional direct-vent fireplace insert installation in accordance with the prior art. The direct-vent fireplace insert 100 is situated within a preformed fireplace cavity 112. Windows 122 may be provided on the insert 100 for viewing a fire 123 within a firebox 110. The insert 100 is connected to an exhaust duct 114, which is routed through a chimney 118 that communicates with the fireplace cavity 112. The illustrated fireplace insert 100 is also connected to a combustion air intake duct 116 concentrically disposed around the exhaust duct 114. In an alternate embodiment, the exhaust duct 114 can be spaced apart from the intake duct 116 so that the exhaust duct is not inside the intake duct.

Direct-vent fireplaces require a balanced flow of combustion air and exhaust gas moving through the intake and exhaust ducts 116 and 114, respectively, to provide an aesthetically desirable flame in the firebox 110. Desirable flame characteristics can include, for example, appearing similar to a natural wood-fire flame. The size, color and action of the flames in the firebox 110 can be adjusted by selectively balancing the flow of combustion air and exhaust gas. A balanced flow also allows direct-vent fireplaces to function in a thermally efficient manner. Accordingly, an important part of the fireplace insert's installation is to properly balance the combustion air intake flow and the exhaust gas flow.

The conventional insert-style fireplace insert 100 is typically installed and balanced by first sliding the insert into a close-fit fireplace cavity 112 so a limited access space 126 is provided between the fireplace insert and the cavity's walls. The installer reaches through the limited access space 126 to connect the fireplace insert to the exhaust duct 114 and the intake duct 116. The installer then balances the flow of combustion air and the exhaust gas while the fire 123 is burning in the firebox 110 in order to visually analyze the flame characteristics. Limited access to the adjustment mechanisms for the intake duct 116 or the exhaust duct 114 can make this balancing a time-consuming and labor intensive process requiring multiple adjustments of the adjustment mechanisms during installation.

SUMMARY OF THE INVENTION

The present invention is directed toward apparatuses and methods for balancing combustion air and exhaust gas for use in direct-vent heater appliances. In one embodiment, the apparatus is a combustion air and exhaust gas balancing system that is in fluid communication with a firebox of a direct-vent heater appliance. The balancing system includes a first valve that is movably adjustable to affect a flow of combustion air into the firebox and a second valve that is movably adjustable to affect a flow of exhaust gas out of the firebox. The second valve is operatively coupled to the first valve so that movement of the first valve is accompanied by a movement of the second valve. In one aspect of this embodiment, the second valve is mechanically and synchronously coupled to the first valve by an elongate actuator shaft so that the flow of combustion air into the firebox and the flow of exhaust gas out of the firebox can be simultaneously adjusted by a single operation of the elongate actuator shaft.

One method for balancing combustion air and exhaust gas in a direct-vent heater appliance in accordance with an embodiment of the invention includes igniting a fire in the firebox, providing a flow of combustion air to the firebox and a flow of exhaust gas from the firebox, visually analyzing the flame to determine if the flows of combustion air and exhaust gas should be adjusted to modify the flame, and manipulating an actuator shaft that synchronously moves a combustion air valve and an exhaust gas valve to simultaneously adjust the flow of combustion air and exhaust gas to provide a selected flame characteristic. Manipulating the actuator shaft can include translating, the actuator shaft in a first direction to simultaneously increase the flows of combustion air and exhaust gas, or translating the actuator shaft in a second direction to simultaneously restrict the flows of combustion air and exhaust gas.

In another embodiment of the invention, a direct-vent heater appliance includes a firebox, a combustion air duct in communication with the firebox, and an exhaust gas duct in communication with the firebox. The exhaust gas duct having at least one dilution air inlet aperture exterior of the firebox. The dilution air inlet aperture is in fluid communication with the combustion air duct and is configured to permit a portion of the combustion air to pass from the combustion air duct to the exhaust gas duct without first passing through the firebox. A separator flue can be positioned in the interior portion of the exhaust gas duct adjacent to the dilution air inlet aperture to form a dilution air passage that receives combustion air from the combustion air duct and disperses the combustion air into the exhaust gas duct at a higher elevation than where the combustion air was received.

DETAILED DESCRIPTION OF THE ILLUSTRATED EMBODIMENTS

In the following description, certain specific details are set forth in order to provide a thorough understanding of various embodiments of the invention. The present disclosure describes apparatuses and methods for controlling the flow of combustion air and exhaust gas in a direct-vent heater appliance. Many specific details of certain embodiments of the invention are set forth in the following, description and in FIGS. 2 through 5 to provide a thorough understanding of these embodiments. One skilled in the art will understand, however, that the present invention may have additional embodiments, or that the invention may be practiced without several of the details described below. In other instances, well known structures associated with direct-vent heater appliances, such as gas lines and burner assemblies in a firebox, have not been shown or described in detail to avoid unnecessarily obscuring the description of the embodiments of the invention.

Figure 1:
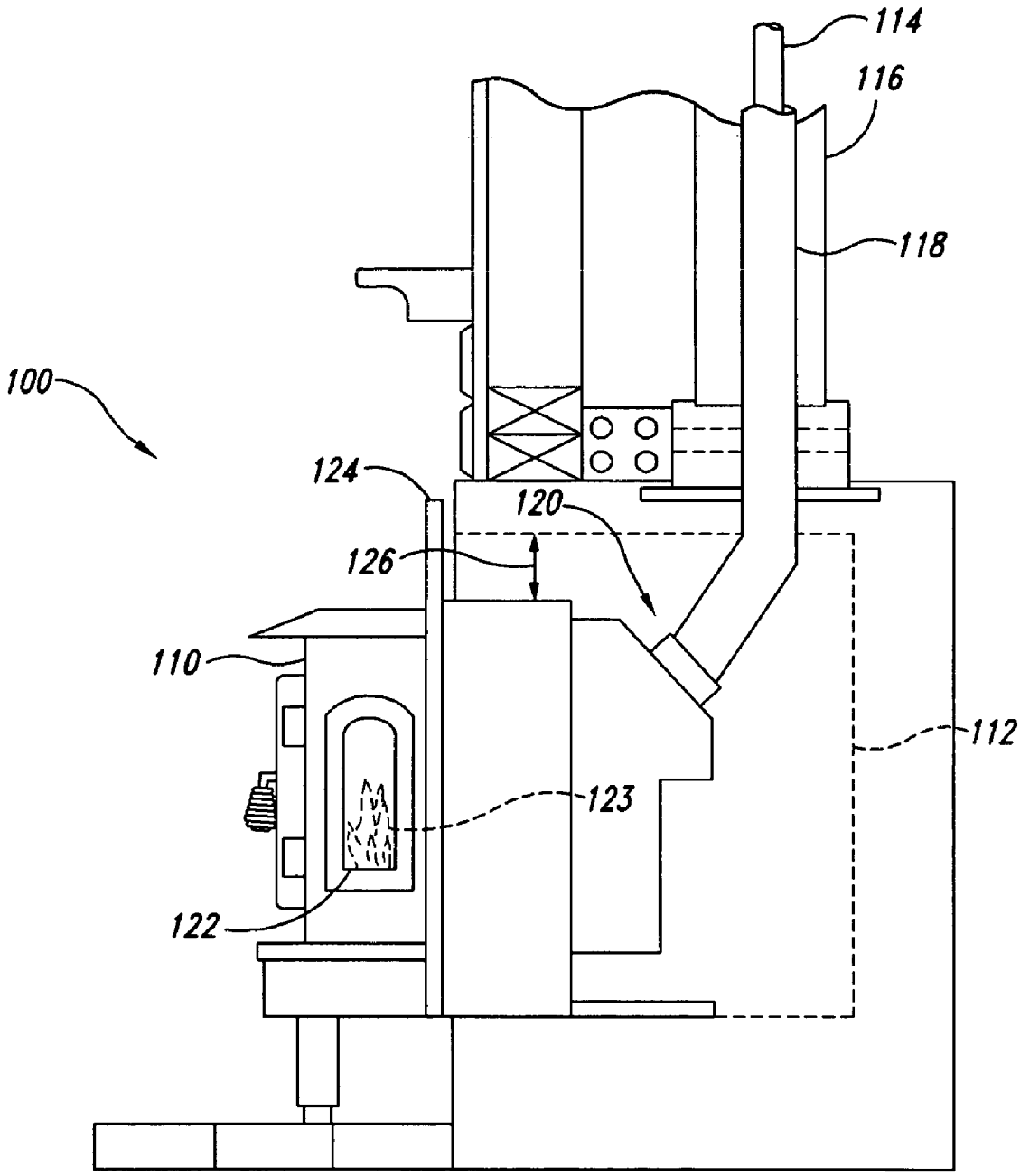
Fig. 1 (Prior Art)
FIG. 1 is a side-elevational view of a prior art direct-vent fireplace insert.
Figure 2:
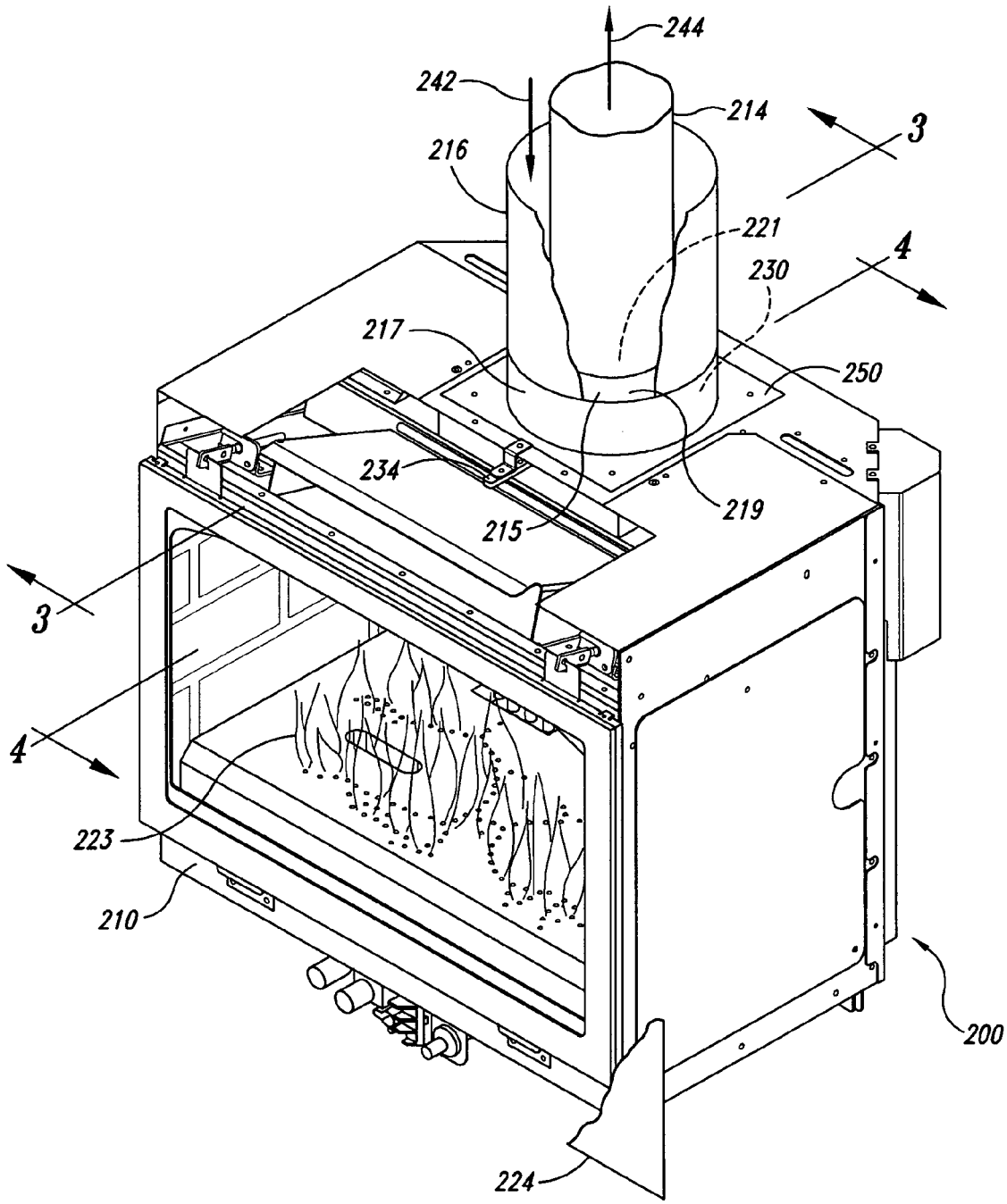
FIG. 2 is a partial cut-away isometric view of a direct-vent fireplace insert showing an insert manifold and a combustion air and exhaust gas balancing system in accordance with an embodiment of the invention.

FIG. 2 is a partial cut-away isometric view of a direct-vent fireplace insert 200 in accordance with one embodiment of the invention. The direct-vent fireplace insert 200 has a firebox 210, a face panel 224 that attaches to the front of the firebox, and an insert manifold 250 that mounts to the top and rear of the firebox. Combustion air 242 is introduced into the firebox 210 through a combustion air intake duct 216, and exhaust gases 244 are expelled from the firebox 210 via an exhaust gas duct 214. The exhaust gas duct 214 is concentrically disposed within the combustion air intake duct 216. The insert manifold 250 has an annular inlet flange 217 connected to the intake duct 216. An annular exhaust flange 215 is concentrically disposed within the annular inlet flange 217 and is connected to the exhaust gas duct 214. The inlet flange 217 and the exhaust flange 215 are spaced apart to form a combustion air passage 219 therebetween through which the combustion air from the combustion air duct 216 passes before flowing to the firebox 210. The exhaust flange 215 defines an interior exhaust passage 221 through which the exhaust gases from the firebox 210 pass before entering the exhaust duct 214.

The insert manifold 250 includes a flow balancing system 230 having an actuator handle 234 located near the front of the insert manifold 250. As will be discussed in greater detail below, the balancing system 230 is configured to allow easy adjustment of the flow of combustion air 242 in the intake duct 216 and exhaust gas 244 in the exhaust duct 214 by adjusting the position of the actuator handle 234.

Figure 3:
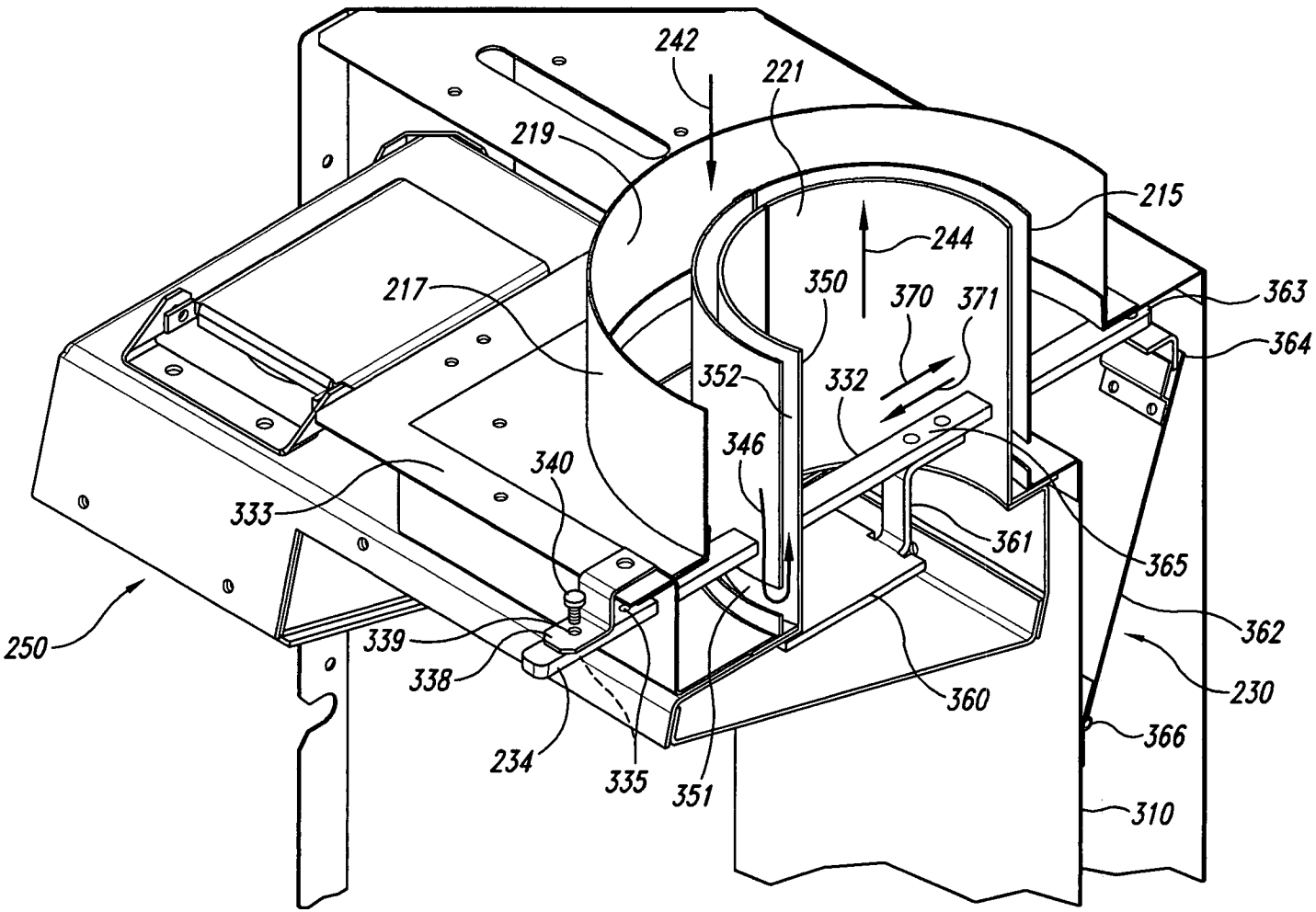
FIG. 3 is an enlarged cross-sectional isometric view taken substantially along line 3—3 of FIG. 2 showing an insert manifold with the combustion air and exhaust gas balancing system.

FIG. 3 is a cross-sectional isometric view of the insert manifold 250 illustrating the combustion air and exhaust gas balancing system 230 in accordance with an embodiment of the invention. The balancing system 230 has a combustion air valve 362 positioned in fluid communication with the annular inlet flange 217. The combustion air valve 362 is adjustable between open and restricted positions to affect the flow of combustion air 242 entering the firebox 210 (FIG. 2).

The balancing system 230 also has an exhaust gas valve 360 positioned in fluid communication with the annular exhaust flange 215. The exhaust gas valve 360 is adjustable between open and restricted positions to affect the flow of exhaust gas 244 exiting the firebox 210. The exhaust gas valve 360 is coupled by an elongate actuator shaft 332 to the combustion air valve 362 so that an installer can simultaneously move the valves between their respective open and restricted positions. Accordingly, the installer can simultaneously adjust the flow of intake air 242 into the firebox 210 and the flow of exhaust gas 244 out of the firebox 210 by moving the actuator shaft 332.

The actuator shaft 232 of the illustrated embodiment is positioned perpendicular to, and at least approximately intersecting, the central axes of the inlet flange 217 and the exhaust flange 215. The actuator shaft 232 is translationally moveable in a closing direction 370 along its longitudinal axis toward a closed or restricted position, and in an opening direction 371 toward an open position opposite to the restricted position.

The combustion air valve 362 is moveably coupled to a distal end 363 of the actuator shaft 332 in a location generally below the inlet flange 217. The combustion air valve 362 is a generally flat plate pivotally attached to a housing 310 of the insert manifold 250 with a hinge 366. The combustion air valve 362 is moveably coupled to the distal end 363 of the actuator shaft 332 with a sliding bracket 364 so that the combustion air valve extends downwardly and away from the actuator shaft 332 and is angularly positionable with respect to the flow of combustion air 242 flowing through the combustion air passage 217. Accordingly, as the actuator shaft 332 moves in the opening direction 371, the combustion air valve 362 pivots about the hinge 366 toward its open position and increases the flow of combustion air 242 entering the firebox 210.

As the actuator shaft 332 moves in the closing direction 370, the combustion air valve 362 pivots about the hinge 366 toward its closed position and restricts the flow of combustion air 242 entering the firebox 210. The combustion air valve 362 in the illustrated embodiment is sized and shaped so that the flow of combustion air 242 through the combustion air passage 219 will not be completely stopped when the actuator shaft 332 is moved to the fully restricted position. The combustion air valve 362 is also sized and shaped to minimize the restriction of the flow of combustion air 242 through the combustion air passage 219 when the actuator shaft 332 is in the fully open position. The sliding bracket 364 is sized and shaped so that the combustion air intake valve 362 will rest flush against the insert manifold housing 310 when the actuator shaft 332 is retracted in the opening direction 371 to the fully opened position.

The exhaust gas valve 360 is attached to the midsection 365 of the actuator shaft 232 by a connector bracket 361 in a location adjacent to the exhaust flange 215 that communicates with the firebox 210. The exhaust gas valve 360 is a generally flat plate mounted to the actuator shaft 332 with the connector bracket 361 so that the exhaust gas valve 360 is substantially parallel to the actuator shaft 332 and perpendicular to the flow of exhaust gas 244 through the exhaust passage 221. Accordingly, as the actuator shaft 332 moves in the opening direction 371, the exhaust gas valve 360 retracts across the opening of the exhaust passage 221 and increases the flow of exhaust gas 244 entering the exhaust gas duct 214. Conversely, as the actuator shaft 332 moves in the closing direction 370, the exhaust gas valve 360 slides across the opening of the exhaust passage 221 and restricts the flow of exhaust gas 244 entering the exhaust gas duct 214.

The exhaust gas valve 360 in the illustrated embodiment is sized and shaped so that the flow of exhaust gas 244 through the exhaust passage 221 will not be completely stopped when the actuator shaft 232 is moved into the fully restricted position. The connector bracket 361 for the exhaust gas valve 360 is positioned to stop the actuator shaft 332 at a predetermined fully restricted position in closing direction 370. The connector bracket 361 is shaped to provide a cantilever support for the exhaust gas valve 360 so that when the actuator shaft 332 is retracted in direction 371 toward the open position, the exhaust gas valve 360 will slide neatly under the lower end of the annular exhaust flange 215 to minimize the restriction of exhaust gas 244 through the annular exhaust flange 215.

The balancing system 230 includes a retention bracket 338 mounted to the insert manifold 250 for securing the actuator shaft 332, and, thus, the exhaust gas valve 360 and combustion air valve 362 in the selected position needed to tune the balancing system 230. The retention bracket 338 has a fastener hole 339 which can be aligned with any one of a plurality of index holes 335 in the actuator shaft 332. A lock bolt 340 or other suitable fastener (pin, screw, etc.) removably extends through the holes 339 and 335 to secure the actuator shaft 332 in the selected position after the balancing system 230 has been tuned. The availability of the index holes 335 in the actuator shaft 332 permits graduated adjustments of the intake and exhaust flows, and also permits selection of pre-determined valve positions to achieve a particular flame characteristic or to adjust the valves for a seasonal change in atmospheric conditions.

Figure 4:
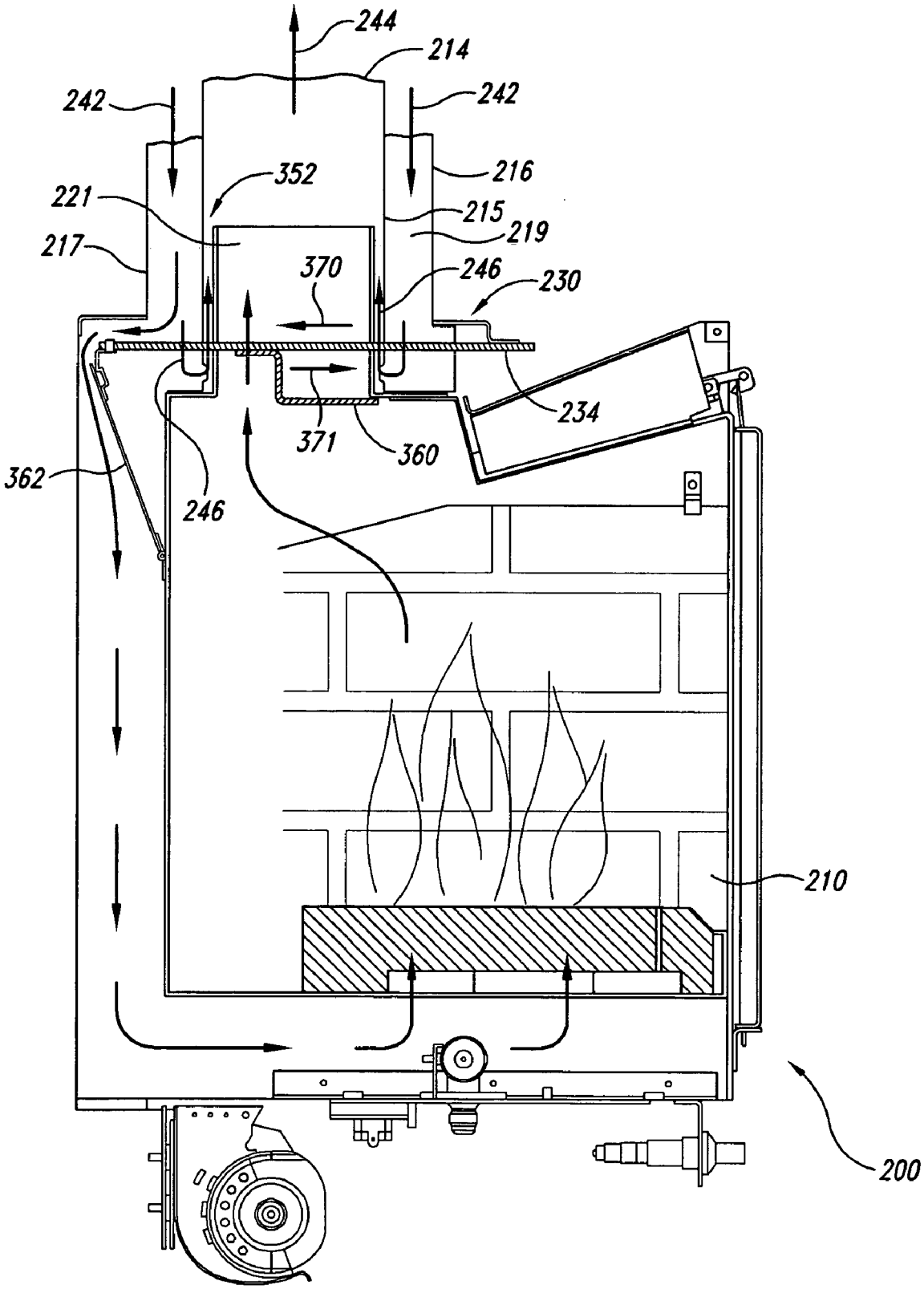
FIG. 4 is a reduced cross-sectional side-elevational view taken substantially along line 4—4 of FIG. 2 showing a flow path of combustion air and exhaust gas in relation to the combustion air and exhaust gas balancing system.

FIG. 4 is a cross-sectional schematic view of the direct-vent fireplace insert 200 illustrating a flow path of the combustion air 242 and the exhaust gas 244 through the balancing system 230 in accordance with one embodiment of the invention. The combustion air 242 flows in through the intake duct 216, through the combustion air passage 219, and around the intake valve 362 before arriving at the firebox 210. The exhaust gas 244 exits the firebox 210 and moves past the exhaust gas valve 360 before flowing through the exhaust passage 221 and into the exhaust gas duct 214. Wen the actuator shaft 332 is moved in the closing direction 370 toward the closed position, both the combustion air valve 362 and the exhaust gas valve 360 simultaneously move toward their respective closed positions by a selected amount to increase the restriction of their respective ducts 216 and 214. Conversely, when the actuator shaft 232 is moved in the opening direction 371 toward the open position, the combustion air valve 362 and the exhaust gas valve 360 simultaneously move toward their respective open positions by a selected amount to decrease the restriction of their respective ducts 216 and 214.

Referring back to FIGS. 2 and 3, one advantage of the balancing system 230 is that the flow of exhaust gas 244 and combustion air 242 can be simultaneously balanced in a single operation of moving the actuator shaft 332 to a selected position between the open and closed positions. Accordingly, the simultaneous movement simplifies and expedites the installation and tuning of the direct-vent fireplace insert 200. For example, it is often desirable to tune a flame 223 to look like a flame from a wood or other natural fuel fire, even though simulated logs are actually placed in the firebox 210 over a gas-burner assembly. To tune the direct-vent fireplace insert 200 to produce a thermally efficient flame with these characteristics, the installer ignites the fire 223 in the firebox 210, and then slides the actuator handle 234 in the closing direction 370 or the opening direction 371 to simultaneously adjust the flow of combustion air 242 and exhaust gas 244 as required to produce the desired flame characteristics in the firebox 210. Once the actuator shaft 332 has been properly positioned to balance the combustion air 242 with the exhaust gas 244 to achieve the desired flame characteristic, the handle 234 is secured to the retention bracket 338 with the lockbolt 340 to maintain the setting. The face plate 224 is then mounted to the front of the direct-vent fireplace insert 200 to complete the installation.

As best seen in FIG. 3, in one embodiment of the invention, the insert manifold 250 includes an annular separator flue 350 that is concentrically disposed within the exhaust flange 215. In the illustrated embodiment, the exhaust flange 215 includes at least one dilution air aperture 351 positioned toward the lower end of the exhaust flange exterior of the firebox 210. Thus, an annular dilution air passage 352 is formed between the annular separator flue 350 and the exhaust flange 215 that communicates with the combustion air passage 219 through the dilution air aperture 351. The dilution air passage 352 permits combustion/dilution air 346 to be siphoned off of the intake air 242 and dispersed into the exhaust passage 221 without first passing through the firebox 210. Accordingly, the diverted portion of combustion air 242 acts to partially dilute and cool the exhaust gas 244 flowing through the exhaust passage 221 and the exhaust gas duct 214.

The combustion/dilution air enters the dilution air passage 352 through the dilution air aperture 351 at an elevation lower than where the combustion/dilution air 346 is dispersed into the exhaust gas 244. Because of this elevation change, the exhaust gas 244 is unlikely to recirculate into the combustion air inlet 217 and mix with the combustion air 242 and adversely affect performance of the fireplace insert 200.

The combustion/dilution air 346 entering the exhaust gas duct 214 can slow the flow of exhaust gas, which will effect the flame's characteristics in the firebox 210 (FIG. 2). The combustion/dilution air 346 is much cooler than the exhaust gas 244 flowing through the exhaust passage 221. This cooler combustion/dilution air 346 lowers the temperature of the hot exhaust gas 244, thereby reducing the temperature differential between the exhaust gas 244 in the exhaust gas duct 214 and the outside air into which the exhaust gas duct opens. Reducing this temperature differential reduces the draw or velocity of exhaust gas 244, which in turn will reduce the velocity of combustion air 242 in the combustion air intake duct 216 or other gas being drawn into the firebox 210, thereby reducing the pull on the flames. Accordingly, the extent of cooling of the exhaust gas 244 affects the characteristics of the flame in the firebox 210.

Figure 5:
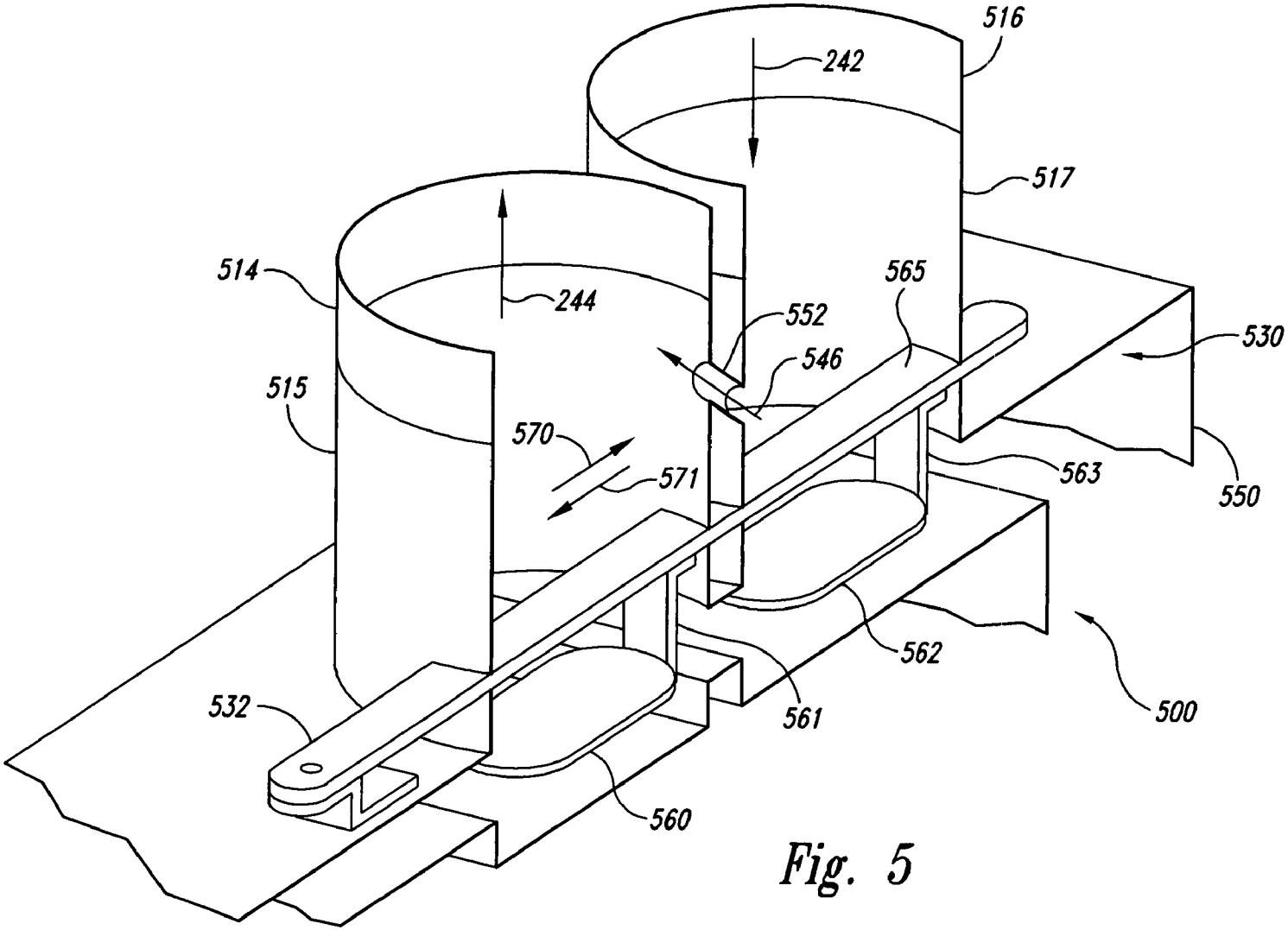
FIG. 5 is an enlarged cross-sectional isometric view of an alternate embodiment of the present invention showing an insert manifold with the combustion air duct spaced apart from the exhaust gas duct.

FIG. 5 is a partial cross-sectional isometric view of an insert manifold 550 having a combustion air and exhaust gas balancing system 530 in accordance with an alternate embodiment of the present inventional. In this embodiment, the balancing system 530 is in fluid communication with a combustion air intake duct 516 and an exhaust gas duct 514 that are spaced apart from each other and not concentrically disposed. The combustion air intake duct 516 is connected to the insert manifold 550 at an annular inlet flange 517, and the exhaust gas duct 514 is connected to the insert manifold 550 at an annular exhaust flange 515 spaced apart from the inlet flange 517.

The balancing system 530 has a combustion air valve 562 positioned in fluid communication with the inlet flange 517. The combustion air valve 562 is adjustable between open and restricted positions to affect the flow of combustion air 242 passing through the inlet flange 517. The balancing system 530 also has an exhaust gas valve 560 positioned in fluid communication with the exhaust flange 515. The exhaust gas valve 560 is adjustable between open and restricted positions to affect the flow of exhaust gas 244 passing through the exhaust flange 515. The exhaust gas valve 560 is coupled by an elongate actuator shaft 532 to the combustion air valve 562 so that an installer can simultaneously adjust the flow of intake air 242 into a firebox and the flow of exhaust gas 244 out of the firebox by a single operation of the actuator shaft 532.

The actuator shaft 532 is positioned perpendicular to and at least approximately intersecting the central axes of the inlet flange 517 and the exhaust flange 515. Importantly, the actuator shaft 532 is translationally moveable in a closing direction 570 along its longitudinal axis toward a restricted position, and in an opening direction 571 toward an open position.

The combustion air valve 562 is attached to a distal end portion 565 of the actuator shaft 532 in a location adjacent to the inlet flange 517 that communicates with the firebox. The combustion air valve 562 is a generally flat plate mounted to the actuator shaft 532 with a connector bracket 563 so that the combustion air valve 562 is substantially parallel to the actuator shaft 532 and perpendicular to the flow of combustion air 242 through the inlet flange 517. Accordingly, as the actuator shaft 532 moves in the closing direction 570 toward the closed position, the combustion air valve 562 slides across the opening of the intake flange 517 and restricts the flow of combustion air 242 entering the firebox. Conversely, as the actuator shaft 532 moves in the opening direction 571 toward the open position, the combustion air valve 562 retracts across the opening of the inlet flange 517 and increases the flow of combustion air 242 entering the firebox. The combustion air valve 562 in the illustrated embodiment is sized and shaped so that the flow of combustion air 242 through the inlet flange 517 will not be completely stopped when the actuator shaft 532 is moved into the fully restricted position.

The exhaust gas valve 560 is attached to the midsection of the actuator shaft 532 in a location adjacent to the exhaust flange 515 that communicates with the firebox. The exhaust gas valve 560 is a generally flat plate mounted to the actuator shaft 532 with a connector bracket 561 so that the exhaust gas valve 560 is substantially parallel to the actuator shaft 532 and perpendicular to the flow of exhaust gas 244 passing through the exhaust flange 515. Accordingly, as the actuator shaft 532 moves in the closing direction 570 toward the closed position, the exhaust gas valve 560 slides across the opening of the exhaust flange 515 and restricts the flow of exhaust gas 244 exiting the firebox. Conversely, as the actuator shaft 532 moves in the opening direction 571 toward the open position, the exhaust gas valve 560 retracts across the opening of the exhaust flange 515 and increases the flow of exhaust gas 244 exiting the firebox. The exhaust gas valve 560 in the illustrated embodiment is sized and shaped so that the flow of exhaust gas 244 through the exhaust flange 515 is not completely stopped when the actuator shaft 532 is moved into the fully restricted position.

The connector brackets 561 and 563 are shaped to provide a cantilever support for their respective valves so that when the actuator shaft 532 is retracted in opening direction 571 toward the open position, the exhaust gas valve 560 and combustion air valve 562 will slide neatly under the lower ends of the exhaust flange 515 and intake flange 517 respectively, in order to minimize restriction of the respective ducts.

Although the exhaust flange 515 and inlet flange 517 are not concentrically disposed like their counterparts are in the balancing system 230 (FIGS. 2–4) discussed above, it will be apparent to those of ordinary skill in the relevant art that the exhaust gas valve 560 and combustion air valve 562 of the balancing system 530 function to achieve a substantially similar balancing of the exhaust gas and combustion air flow to obtain a desired flame characteristic. Accordingly, it will also be apparent to those of ordinary skill in the relevant art that various alternative configurations of the balancing system 230 are possible without departing from the spirit or scope of the present invention.

Referring again to FIG. 5, the balancing system 530 can also include an alternate embodiment of a dilution air passage 552 for passing combustion/dilution air 546 between the inlet flange 517 and the exhaust flange 515 without first passing it through the firebox 210. The dilution air passage 552 can be provided in the form of an inclined conduit. It will be apparent to those of ordinary skill in the relevant alt, that various alternate configurations of the dilution air passage 352 are possible in accordance with other embodiments of the present invention.

Although specific embodiments of, and examples for, the invention are described herein for illustrative purposes, various modifications can be made without departing from the spirit and scope of the invention, as will be recognized by those of ordinary skill in the relevant art. The teachings provided herein of the present invention can be applied not only to direct-vent gas-burning and wood-burning fireplace assemblies, but to all direct-vent heater appliances as well, whether they are incorporated into cavities in the dwelling or structure in which they are used, or if they are free-standing. The teachings provided herein apply to these other embodiments, and not necessarily the exemplary direct-vent fireplace insert assembly generally described above. These and other changes can be made to the invention in light of the above detailed description. In the following claims, the terms used should not be construed to limit the invention to the specific embodiments disclosed in the specification and the claims, but should be construed to include all direct-vent heater appliances that operate in accordance with the claims. Accordingly, the invention is not limited by the disclosure, but instead its scope is to be determined entirely by the following claims.

We claim:

1. A direct-vent fireplace assembly, comprising:

a firebox;

a combustion air duct in communication with the firebox and configured to contain a flow of combustion air, the combustion air duct having an inlet with a central axis;

an exhaust gas duct in communication with the firebox and configured to contain a flow of exhaust gas, the exhaust gas duct having an outlet with a central axis, the central axis of the exhaust gas duct outlet being at least approximately co-axially disposed in relation to the central axis of the combustion air duct inlet;

a first valve located at least adjacent to the combustion air duct, the first valve being rotatably positionable relative to the combustion air duct to affect the flow of combustion air in the combustion air duct;

a second valve located at least adjacent to the exhaust gas duct, the second valve being translationally positionable relative to the exhaust gas duct to affect the flow of exhaust gas in the exhaust gas duct; and an actuator having a first end toward a first direction and a second end toward a second direction and a midsection between the first and second ends, the actuator having a handle portion toward the first end and a longitudinal axis positioned substantially perpendicular to and at least approximately intersecting the central axes of the combustion air duct inlet and the exhaust gas duct outlet, the actuator being translationally positionable in the first and second directions along its longitudinal axis, the first valve being rotatably coupled to the second end of the actuator so that a translational movement of the handle portion in the first direction rotates the first valve to allow an increased flow of combustion air in the combustion air duct, and a translational movement of the handle portion in the second direction will rotate the first valve to restrict the flow of combustion air in the combustion air duct, the second valve being fixedly attached to the midsection of the actuator so that a translational movement of the handle portion in the first direction will translate the second valve in the first direction and increase the flow of exhaust gas in the exhaust gas duct, and a translational movement of the handle portion in the second direction will translate the second valve in the second direction and restrict the flow of exhaust gas in the exhaust gas duct.

2. The direct-vent fireplace assembly of claim 1, wherein the second valve is positioned substantially perpendicular to the central axis of the exhaust gas duct outlet.

3. The direct-vent fireplace assembly of claim 1, wherein the first and second valves are generally rectangular flat plates.

4. The direct-vent fireplace assembly of claim 1, further comprising:

a retention bracket with a fastener aperture, the retention bracket being fixedly attached to the direct-vent fireplace assembly so that the fastener aperture is adjacent to the handle portion of the actuator, wherein the actuator includes a plurality of indexing apertures near the handle portion that are optionally alignable with the fastener aperture on the retention bracket; and a fastener that is releasably insertable into the retention bracket aperture and a selected aligned indexing aperture to secure the actuator in a selected position after adjustment of the first and second valves.

5. The direct-vent fireplace assembly of claim 1, wherein the exhaust gas duct has at least one dilution air inlet aperture exterior of the firebox and in fluid communication with the combustion air duct, the dilution air inlet aperture being configured to permit a portion of the combustion air flow from the combustion air duct that has not passed through the firebox to pass from the combustion air duct into the exhaust gas flow moving away from the firebox in the exhaust gas duct.

6. The direct-vent fireplace assembly of claim 5, wherein the exhaust gas duct has two dilution air inlet apertures.

* * * * *

UNITED STATES PATENT AND TRADEMARK OFFICE

CERTIFICATE OF CORRECTION

PATENT NO. : 7,066,170 B1
APPLICATION NO. : 10/683172
DATED : June 27, 2006
INVENTOR(S) : Atemboski et al.

It is certified that error appears in the above-identified patent and that said Letters Patent is hereby corrected as shown below:

Column 5
Line 59, "Wen" should be --When--;

Column 7
Line 6, "inventional" should be --invention--;

Column 8
Line 42, "alt," should be --art,--;

Signed and Sealed this

Third Day of October, 2006

JON W. DUDAS
*Director of the United States Patent and Trademark Office*